US008434268B2

(12) United States Patent
Nixon

(10) Patent No.: US 8,434,268 B2
(45) Date of Patent: May 7, 2013

(54) METHOD FOR INSTALLING DOOR OPERATING APPARATUS

(75) Inventor: Angelo Nixon, Carlsbad, CA (US)

(73) Assignee: Opcon International Holdings, L.P., Carlsbad, CA (US)

( * ) Notice: Subject to any disclaimer, the term of this patent is extended or adjusted under 35 U.S.C. 154(b) by 14 days.

(21) Appl. No.: 13/216,071

(22) Filed: Aug. 23, 2011

(65) Prior Publication Data

US 2011/0302848 A1 Dec. 15, 2011

Related U.S. Application Data

(62) Division of application No. 12/107,017, filed on Apr. 21, 2008, now abandoned.

(60) Provisional application No. 60/925,488, filed on Apr. 20, 2007.

(51) Int. Cl.
*E06B 3/00* (2006.01)

(52) U.S. Cl.
USPC ..... 49/506; 49/333

(58) Field of Classification Search ..... 49/333, 49/334, 335, 400, 401, 506
See application file for complete search history.

(56) References Cited

U.S. PATENT DOCUMENTS

| | | | | |
|---|---|---|---|---|
| 1,129,391 | A | 2/1915 | Hohne et al. | |
| 1,367,931 | A | 2/1921 | Varnum | |
| 2,911,210 | A * | 11/1959 | Ferguson | 49/137 |
| 4,220,051 | A | 9/1980 | Catlett | |
| 4,599,824 | A | 7/1986 | Mitsuhashi et al. | |
| 5,036,620 | A | 8/1991 | Beran et al. | |
| 5,193,647 | A | 3/1993 | O'Brien, II | |
| 5,221,239 | A * | 6/1993 | Catlett | 475/342 |
| 5,417,011 | A | 5/1995 | Keszthelyi | |
| 5,669,843 | A * | 9/1997 | Bolton et al. | 475/149 |
| 6,026,720 | A | 2/2000 | Swank | |
| 6,108,975 | A | 8/2000 | Bailey | |
| 6,176,044 | B1 | 1/2001 | Nixon et al. | |
| 6,234,024 | B1 | 5/2001 | Brunty et al. | |
| 7,228,659 | B2 | 6/2007 | Romero et al. | |
| 7,513,078 | B2 * | 4/2009 | Ho | 49/334 |
| 7,816,875 | B2 | 10/2010 | Taheri et al. | |
| 8,091,283 | B2 | 1/2012 | Nixon | |
| 2008/0256870 | A1 | 10/2008 | Nixon | |
| 2010/0278602 | A1 | 11/2010 | Clark, II et al. | |

FOREIGN PATENT DOCUMENTS

| | | |
|---|---|---|
| GB | 2265180 | 9/1993 |

* cited by examiner

*Primary Examiner* — Katherine Mitchell
*Assistant Examiner* — Catherine A Kelly
(74) *Attorney, Agent, or Firm* — Jonathan C. Parks, Esq.; Pietragallo Gordon Alfano Bosick & Raspanti, LLP

(57) ABSTRACT

A method for installing a retrofit conversion kit for converting a door operating apparatus from overhead use to underground use and for operating a swinging door while protecting the door apparatus against moisture and dust encroachment within its underground location. A seal arrangement provides this contamination encroachment protection.

5 Claims, 4 Drawing Sheets

METHOD FOR INSTALLING DOOR OPERATING APPARATUS

CROSS-REFERENCE TO RELATED APPLICATIONS

This application is a divisional application of application Ser. No. 12/107,017, filed 21 Apr. 2008, which claims the benefit of provisional application Ser. No. 60/925,488, filed 20 Apr. 2007, which applications are hereby incorporated herein by reference.

FIELD OF INVENTION

The invention relates generally to powered door operating systems for operating swinging doors and, more particularly, to a method for retrofitting door and installing an operating apparatus, particularly for building ingress and egress doors.

BACKGROUND

Automatic doors are doors that are powered open or powered closed or both. If an automatic door is powered open only, then it is conventionally spring closed or hydraulically closed. Automatic doors typically employ a sensor or switch to activate the door. The sensor detects approaching traffic and may be a motion sensor, infrared sensor, or pressure sensor. The switch is conventionally operated manually and may take the form of a push button, swipe card, or other available switch type access or security system. Alternatively the switch may be activated by pushing or pulling the door, so that once the door detects the movement it completes the open and close cycle. These are also known as power-assisted doors.

Swinging doors are hinged and pivot around an axis in an inward or outward direction or both. Automatic swinging doors are coupled to a source of torque, that is, a door operating apparatus, for providing the force necessary to pivot the door open or closed, or both. Most commercially available door operating apparatuses are electromechanical or electrohydraulic and are positioned above the door in an overhead position for ease and economy of installation. Most commercially available door operating apparatuses are spring closed.

It is sometimes desirable to position the door operating apparatus in a sub-floor stratum. The Tormax Model TN ("Tormax" is registered trademark of Landert Motoren AG, Büach-Zürich, Switzerland) is a floor mounted door operator and is manufactured as an automatic door operator. The Model TN is an underground hydraulic closer with a remotely mounted electric pump system that pushes hydraulic fluid within a floor closer to operate a door. The pump system and electronics are mounted remotely and are not mounted underground. The Model TN is a hydraulic device and is not considered an electromechanical door operating apparatus. Commercially available electromechanical door operating apparatuses designed for use underground or in a sub-floor stratum are unknown.

U.S. Pat. No. 6,176,044 discloses a kit and method for retrofitting electromechanical or equivalent door operating apparatuses. The retrofit kit shown in this patent is employable for converting any door operating apparatus for operating a swinging door from overhead use to underground use. The retrofit kit has had general success in the market place.

SUMMARY OF INVENTION

The invention is directed to a method for employing a retrofit conversion kit for converting a powered door operating apparatus from overhead use to underground use wherein the apparatus improvement includes the addition of a sealing arrangement for protecting the door operating apparatus against moisture and/or dust encroachment within its underground location. In a preferred embodiment, the door operating apparatus which is to be retrofitted is electromechanical or self-contained electrohydraulic, or is otherwise of a type that is generally intolerant to moisture. Also, in this preferred embodiment, the door operating apparatus is of a type that is designed for operation from a position other than the sub-floor stratum. Typically, the retrofit conversion kit is employed for converting the door operating apparatus from overhead use to underground use.

The problem solved by the invention was not recognized in the prior art. It is disclosed herein that electronic and mechanical components of door operating apparatuses can be negatively affected if they are placed underground or within a floor. There is an enhanced likelihood that moisture or dust, or both, can encroach into the mechanical components of the door operating apparatus or the electronic components of the door operating system, or both, if they are located underground or within a floor. This can cause the components to fail and can create a hazardous situation. Moving parts can corrode and become maintenance issues when not in a sealed environment.

It is further disclosed herein that the area most susceptible to moisture encroachment is the area where the spindle exits the enclosure to engage the door above. Any seal employed to seal the enclosure with the spindle of the kit described in U.S. Pat. No. 6,176,044 (incorporated herein by reference) must permit rotation of the spindle without compromising the effectiveness of the seal. The seal must also be thin enough to not impact the height requirement of the enclosure within the underground or sub-floor excavation.

A further surprising aspect of the invention was the discovery that the addition of the sealing arrangement enhanced the mechanical performance properties of the device. The addition of the sealing arrangement to the retrofit conversion kit surprisingly provides enhanced lateral support to the spindle when a door coupled thereto experiences major lateral forces.

BRIEF DESCRIPTION OF DRAWING

The objects, advantages, and features of the invention, as shown in the exemplary embodiments, will be more clearly perceived from the following description, when read in conjunction with the accompanying drawing, in which.

DETAILED DESCRIPTION OF PREFERRED EMBODIMENTS

Figure 1:
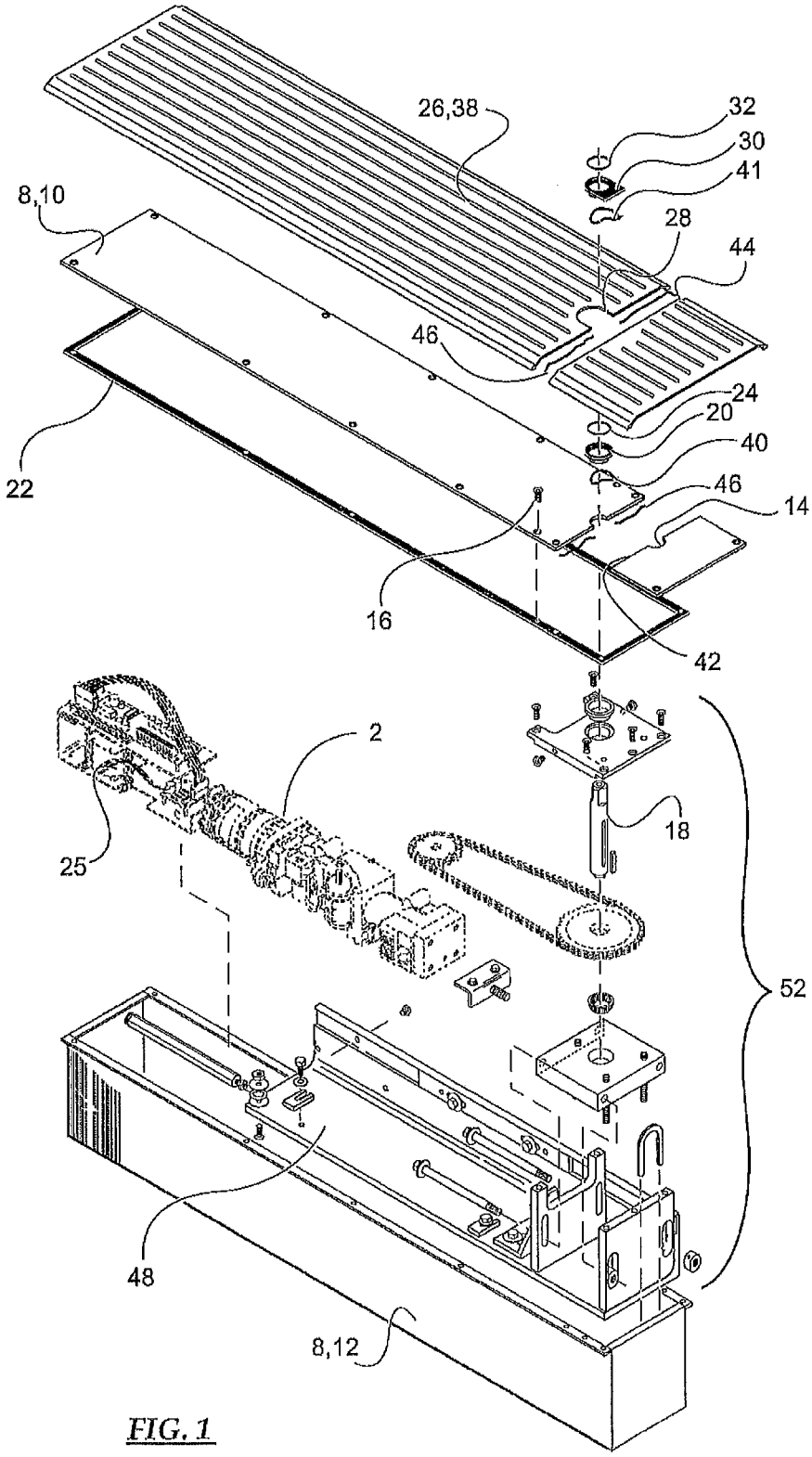
FIG. 1 is an exploded perspective view illustrating both a door operating apparatus and a door operating system (shown in phantom) and all components of an exemplary kit for retrofitting both the door operating apparatus and door operating system to underground use, illustrating all components of the exemplary kit that serve as positional adjustment mechanisms.
Figure 2:
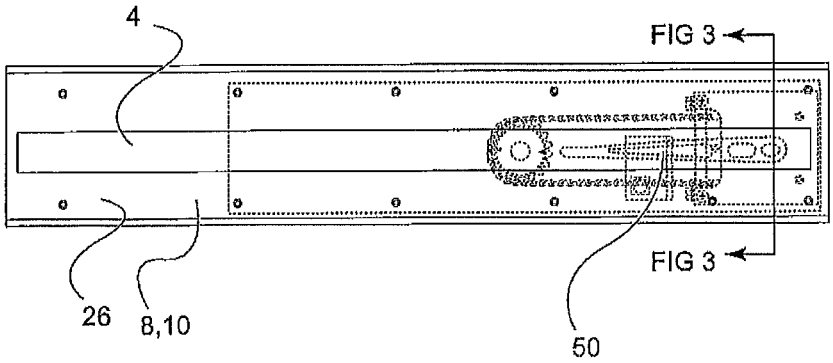
FIG. 2 is a planar overhead view illustrating the closed position of a door, a door arm, and a retrofitted door operating apparatus, in accordance with the invention.
Figure 3:
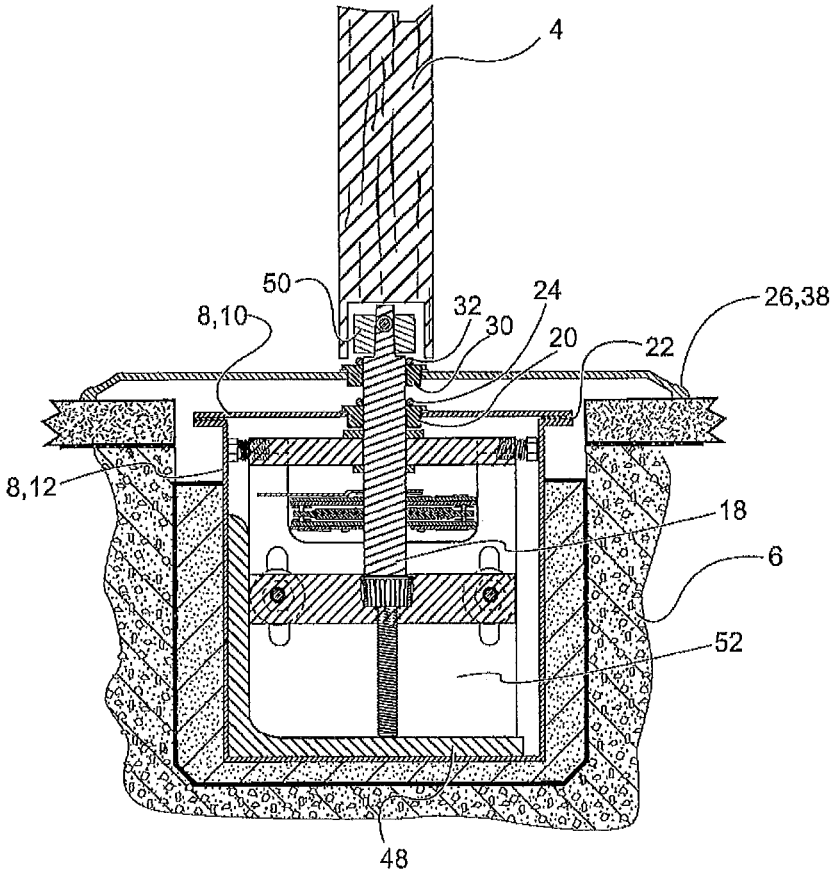
FIG. 3 is a sectional view taken through cutting plane 3-3 of FIG. 2, illustrating an exemplary retrofitting kit having a plate threshold and all sealing arrangements in accordance with the invention.
Figure 4:
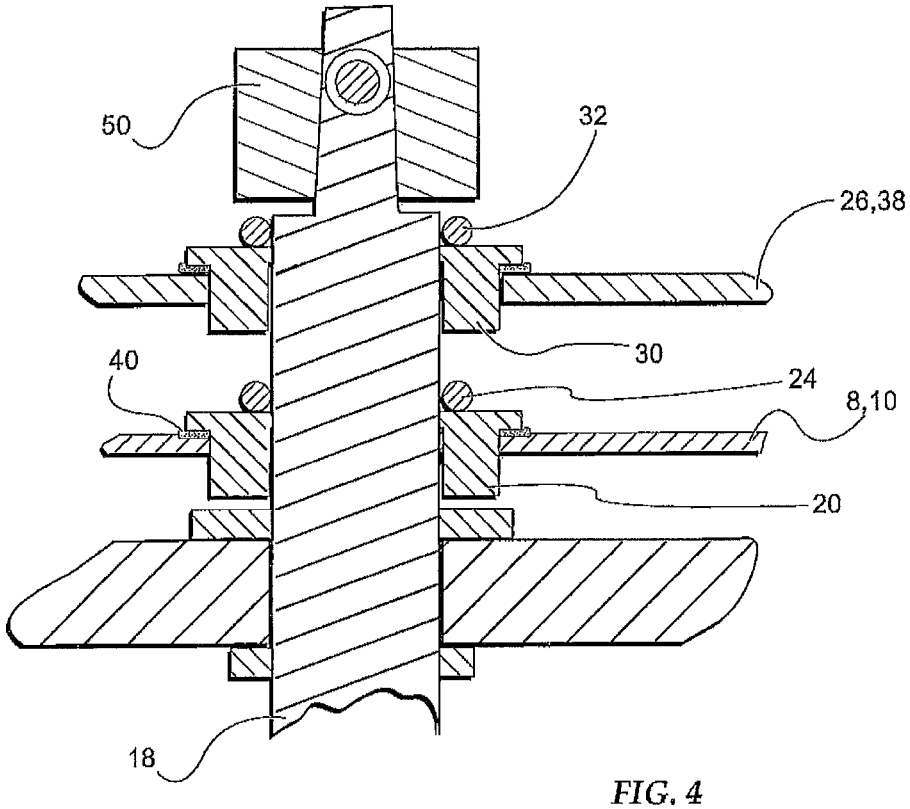
FIG. 4 is an enlarged fragment of the sectional view of FIG. 3 illustrating cross sections of two sealing rings and their associated O-rings for sealing the spindle, the upper sealing ring being sealed to the plate threshold with a sealant layer and the lower sealing ring being sealed to the upper portion of the enclosure with another sealant layer, and contrasting the sealing rings with the metal bearing ring associated with the top plate.
Figure 5:
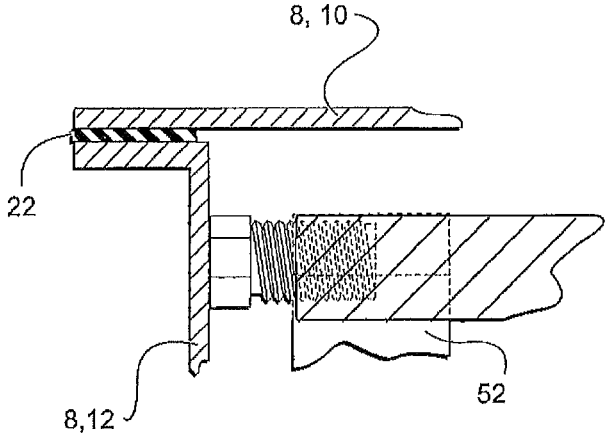
FIG. 5 is a further enlarged portion of the sectional view of FIG. 2 illustrating the gasket sandwiched between the rims of the upper and lower portions of the enclosure.

One aspect of an embodiment of the invention is directed to a retrofit conversion kit for coupling a conventional door operating apparatus (2) to a swinging door (4) for operating the swinging door (4) from a sub-floor stratum (6) and for sealing the door operating apparatus (2) within the sub-floor stratum (6). In a preferred mode, the door operating apparatus (2) is electromechanical or is otherwise of a type that is generally intolerant to moisture. Also, in a preferred mode, the door operating apparatus (2) is of a type that is designed for operation from a position other than the sub-floor stratum (6). Typically, the retrofit conversion kit is employed for converting the door operating apparatus (2) from overhead use to underground use.

The retrofit conversion kit includes an enclosure (8) for containing the door operating apparatus (2). The enclosure (8) includes an upper portion (10) and a lower portion (12). The upper and lower portions (10 and 12) of the enclosure are made of a moisture impervious material and are attachable and detachable to and from one another for providing access for installing and adjusting the door operating apparatus (2) within the lower portion (12) of the enclosure. The lower portion (12) of the enclosure is anchorable within the sub-floor stratum (6). The upper portion (10) of the enclosure defines a first hole (14). One or more fasteners (16) are provided for fastening and unfastening the upper and lower portions (10 and 12) of the enclosure. Preferred fasteners (16) are press-fitted rivet nuts, machine pressed into the lower enclosure portion (12), with machine screws inserted through the fastening holes (16) in the upper enclosure portion (10). The retrofit conversion kit also includes a spindle (18). The spindle (18) is adapted for rotationally engaging the door operating apparatus (2) within the enclosure (8). The spindle (18) is also adapted for passing through the first hole (14) of the enclosure (8) for vertically and rotationally engaging the swinging door (4) both for providing vertical support to the swinging door (4) and for transmitting torque from the door operating apparatus (2) to the swinging door (4).

The retrofit conversion kit also includes various sealing arrangements. A first sealing ring (20) encircles the first hole (14) and forms a moisture tight seal with the upper portion (10) of the enclosure. The first sealing ring (20) is adapted for providing both passage of the spindle (18) through the first hole (14) and rotational freedom of the spindle (18) within the first hole (14) while simultaneously forming a moisture tight seal between the spindle (18) and said first sealing ring (20). The first sealing ring (20) also provides lateral support between the enclosure (8) and the spindle (18). In a preferred embodiment, the first sealing ring (20) has a composition of self-lubricating thermoplastic. A gasket (22) is positioned between the upper and lower portions (10 and 12) of the enclosure for making a moisture tight seal therebetween when the upper and lower portions (10 and 12) of the enclosure are attached to one another by one or more of the fasteners (16). In a preferred embodiment, the gasket (22) has a vinyl composition. When the retrofit conversion kit is fully assembled and installed within a sub-floor stratum (6), the enclosure (8) provides an overall moisture tight containment of the door operating apparatus (2) when operating from the sub-floor stratum (6).

The sealing arrangements taken together and in combination with the other structural elements of the retrofit conversion kit also serve a surprising mechanical function. Under normal use conditions, bearings in the bearing plate and in the top plate provide lateral support to the spindle (18) to cope with lateral forces upon the swinging door (4). However, when excess lateral force is applied to the swinging door (4), the structural support for these bearings can contort. In these instances, the first sealing ring (20) can take on a temporary bearing function and can provide additional lateral support to the spindle (18) and to the door (4). The lateral bearing force born by the first sealing ring (20) is transferred to the enclosure (8) anchored to the sub-floor stratum (6). Hence, the first sealing ring (20) can provide occasional mechanical functions, as well as maintaining its scaling function.

In a preferred embodiment of the retrofit conversion kit, the first sealing ring (20) includes a first O-ring (24) for contacting the spindle (18) for facilitating the formation of the moisture tight seal between the first sealing ring (20) and the spindle (18). In a preferred embodiment, an automatic door operator system (25) is coupled to the door operating apparatus (2) and is enclosed therewith within the enclosure (8). When the enclosure (8) is sealed, it provides an overall moisture tight containment of the door operating apparatus (2) and the automatic door operator system (25) coupled thereto when operating from the sub-floor stratum (6).

Figure 6:
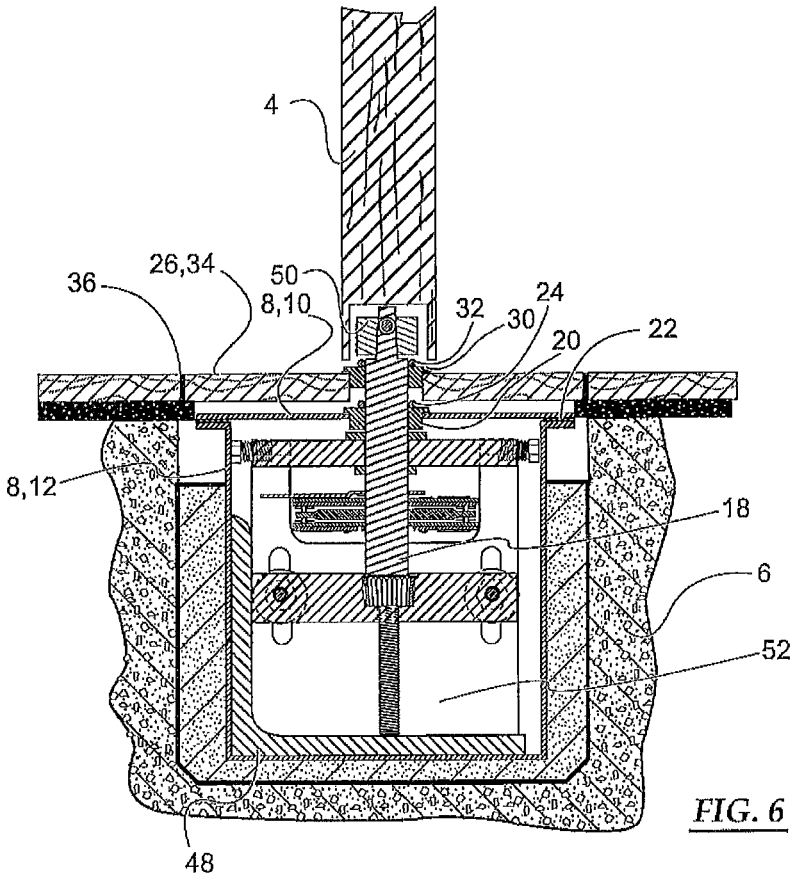
FIG. 6 is a sectional view illustrating an alternative embodiment of the retrofitting kit having a flooring threshold rather than a plate threshold, as illustrated in FIG. 3.

In another preferred embodiment of this aspect of the invention, the retrofit conversion kit further comprises a threshold cover (26) for spanning over the enclosure (8), the threshold cover (26) defining a second hole (28) for accommodating the passage of the spindle (18) therethrough. This threshold cover (26) includes a second sealing ring (30) that encircles the second hole (28) and forms a moisture tight seal with the threshold cover (26). The second sealing ring (30) is adapted for providing both passage of the spindle (18) through the second hole (28) and rotational freedom of the spindle (18) within the second hole (28) while simultaneously forming a moisture tight seal between the spindle (18) and said second sealing ring (30). In a preferred embodiment, the second sealing ring (30) has a composition of self-lubricating thermoplastic. The second sealing ring (30) preferably includes a second 0-ring (32) for contacting the spindle (18) for facilitating the formation of the moisture tight seal between the second sealing ring (30) and the spindle (18). In a preferred embodiment, the optional threshold cover (26) is flooring material (34) (FIG. 6). In this instance, the flooring material (34) may further include silicone joint material (36) attached thereto for forming a moisture tight seal between the flooring material (34) and the sub-floor stratum (6) and/or with a floor above the sub-floor stratum (6). In another preferred embodiment, the optional threshold cover (26) is a flat transition plate (38) without the typical sloping edges of a threshold. This flat plate transitions between interior and exterior flooring in a level plane, thus allowing smoother ingress and egress for wheelchairs and other wheeled vehicles.

In another embodiment of this aspect of the invention, the door operating apparatus (2) is of a type that requires power from an external electric power line or requires an electrical connection between multiple door operating apparatuses. In this instance, the installer forms an opening in the enclosure (8) for passing the electric power line thereinto for powering the door operating apparatus (2). In a preferred mode, the seal integrity of the enclosure (8) is maintained by using liquid-tight electrical fittings that offer an internal gasket within the fitting that attaches to the enclosure by appropriate means, such as bolts.

The invention is also directed to a process for coupling a swinging door (4) to a door operating apparatus (2) from a sub-floor stratum (6). In a preferred mode, the door operating apparatus (2) is of a type that is electromechanical and generally moisture intolerant and designed for operation from a position other than a sub-floor stratum (6). A lower portion (12) of an enclosure is anchored within the sub-floor stratum (6). The door operating apparatus (2) and a coupling device are installed within the lower portion (12) of the enclosure. The door operating apparatus (2) and a coupling device are rotationally coupled to one another. The coupling device includes a spindle (18) for rotationally coupling to the swinging door (4). The door operating apparatus (2) and the coupling device are sealed within the enclosure (8) with a moisture tight seal by attaching an upper portion (10) of the enclosure to the lower portion (12) of the enclosure with a gasket (22) therebetween while simultaneously providing for a moisture tight rotationally free passage of the spindle (18) through the upper portion (10) of the enclosure. Then the spindle (18) is vertically and rotationally engaged with the swinging door (4) for providing vertical support to the swinging door (4) and for transmitting torque from the door operating apparatus (2) to the swinging door (4). In the assembled state, the enclosure (8) provides an overall moisture tight containment of the door operating apparatus (2) when operating from the sub-floor stratum (6).

EXAMPLE

A preferred example of the invention is a modified and improved version of the retrofit conversion kit disclosed in U.S. Pat. No. 6,176,044 ('044). The '044 patent discloses a kit for converting any manufacturer's overhead mounted swinging door operating apparatus from overhead use to underground use. The present invention is directed to a similar kit and method for installation, except that the kit of the present invention additionally protects the door operating apparatus against moisture and dust encroachment within its underground location. More particularly, the present invention includes a water tight sealing ring (20) for sealing the spindle (18) within the enclosure (8) and a water tight gasket (22) for sealing the two halves of the enclosure (8). Preferred gaskets (22) have a vinyl composition. This sealing system renders the enclosure (8) watertight and enables the door operating apparatus (2), including its electronic components, to be self-contained and protected against water and dust encroachment within the enclosure (8). Use of this sealing system as part of the conversion kit referred to above affords the first conversion kit that enables an overhead electromechanical automatic door operating apparatus to be converted for use in a sub-floor position within a self-contained enclosure (8) that is sealed against moisture and dust encroachment. This sealing system can be unsealed to provide access to the underground components for maintenance or adjustments and can be re-sealed without compromising the integrity of the seal. The sealing system is reusable and permits continual access within the enclosure (8) to the components of the automatic door operating apparatus (2) and system (25), and provides a moisture-tight enclosure (8), while permitting rotation of the apparatus spindle (18).

In a preferred embodiment, the sealing system includes a first (20) or second (30) sealing ring or both. The first sealing ring (20) is mounted with a moisture-tight fit in the first hole (14) of the upper portion (10) of the enclosure through which the spindle (18) exits. The moisture tight fit can be achieved by the application of a layer (40) of sealant between the surface of the enclosure (8) and the sealing ring (20). A preferred sealant (40) for forming this layer is a commercially available viscous sealant paste that develops into a semi-flexible seal for increasing the reliability of gasket seals, such as Permatex Form-A Gasket No. 2 Non-Hardening Sealant ("Permatex" and "Form-A-Gasket" are trademarks of Permatex, Inc, Hartford, Conn.). The second sealing ring (30) is mounted with a water tight seal in the second hole (28) of the threshold cover (26) through which the spindle (18) exits. This moisture tight fit can be achieved by the application of a layer (41) of sealant between the surface of the threshold cover (26) and the second sealing ring (30). A preferred sealant for forming this layer (41) is also Permatex Form-A Gasket No. 2 Non-Hardening Sealant. If the first and second sealing rings (20 and 30) are employed with a retrofit kit having an adjustable spindle location (as described in co-pending patent application Ser. No. 12/107,018, entitled "ADJUSTABLE SPINDLE ARRANGEMENT FOR DOOR OPERATING APPARATUS RETROFIT KIT," filed Apr. 21, 2008), the first and second sealing rings (20 and 30) are aligned with the spindle in its desired location before they are mounted with the layer of sealant (40 and 41, respectively). Co-pending patent application Ser. No. 12/107,018 and its disclosure are incorporated herein by reference.

In a first variant of this preferred embodiment, the upper portion (10) of the enclosure and includes a splice (42) that bisects the first hole (14) for facilitating the disassembly of the upper portion (10) of the enclosure for providing access to the door operating apparatus (2) therein. In second variant of this preferred embodiment, the threshold cover (26) includes splice (44) that bisects the second hole (28) for facilitating the disassembly of the threshold cover (26) for providing access to the door operating apparatus (2) therein. Both the first and second variants may be employed simultaneously to achieve optimal access to the door operating apparatus (2). With either or both variants, the splices are sealed by the application of silicone sealant (46).

The preferred compositions for the sealing rings (20 and 30) are self-lubricating high performance engineering thermoplastics characterized by their dimensional stability, low friction, stiffness, and fatigue, corrosion, and wear resistance, such as polyoxymethylene (a polymer with the chemical formula $—(—O—CH_2—)_n—$), commonly known under the brand name of Delrin ("Delrin" is a registered trademark of E. I. du Pont de Nemours and Company, Delaware) or such as polyamide (nylon). It was found that conventional off-the-shelf seal products such as bearing seals and sheet vinyl cut to fit these holes were ineffective for this application because they become damaged when the spindle (18) is turned so as to permit leakage when exposed to water. Also, they were not reusable, that is, if the enclosure (8) is accessed for servicing the door operating apparatus (2) therein, the seals tended to become damaged so as to become leaky. Also, although conventional shaft seals are available for containing liquids in machinery and equipment, these seals are not designed for protecting electronics and mechanical components in a wet-weather environment typical of many floor surfaces and/or in dusty environments which often pertain with building ingress and egress. Also, these conventional shaft seals are not designed for repeated assembly and disassembly with respect to the exiting shaft. In contrast, sealing rings (20 and 30), in accordance with the invention having a composition of self-lubricating thermoplastic products, are much less subject to damage by repeated rotations of the spindle (18), or by accessing the interior of the enclosure (8), or both, and exhibit much superior performance with respect to maintenance of the integrity of the seal. Performance of the sealing rings (20 and 30) is further enhanced by addition of an "O" ring. The first sealing ring (20) is attached to the upper portion (10) of the enclosure and thereby helps spread the lateral forces exerted on the spindle (18) over a larger area of the entire enclosure (8) so as to help secure the mounting sled (48) assembly to the enclosure (8). Sealing rings (20 and 30), having a composition of self-lubricating thermoplastic products, are much more durable and less subject to damage as compared to conventional off-the-shelf seal products such as bearing seals and sheet vinyl, especially when the enclosure (8) is disassembled for accessing the interior for servicing the components therein.

A feature of the invention is that all necessary operating components are enclosed within the enclosure (8) so that there is no need for any components to be remotely mounted or remotely interfaced. The operating components can include expensive control systems and computers that are highly sensitive to moisture and dust encroachment. In many construction situations, there simply is not enough unused and available area to remotely mount electronic equipment for use with a sub-floor automatic door operating apparatus (2). This is a particularly important with monumental, all-glass swinging doors and with historic preservation type doors. Additionally, voltage drops can occur with remote mounting of the electronics and low voltage signal strength can be compromised if long wiring is employed between the torque mechanism and the remotely mounted operator control systems. The market has become accustomed to the electronics provided with commercially available automatic door operators.

Use of the kit for retrofitting a door operating apparatus (2) disclosed herein results in greater reliability and longevity of the electronic and mechanical components of the door operating apparatus (2) and the automatic door operating system (25) sealed within the enclosure (8). Water, moisture, and dust encroachment can be greatly reduced, and even substantially eliminated.

Use of the kit for retrofitting a door operating apparatus (2) disclosed herein results in easier maintenance and service calls due to the ready access to the interior of the sealed enclosure (8) for servicing the components therein. It also reduces the cost because the sealing rings (20 and 30) do not need to be replaced each time the enclosure (8) is accessed, nor does the door (4) need to be removed.

Use of the kit for retrofitting a door operating apparatus (2) disclosed herein results in enhanced aesthetics because installation in a sub-floor stratum (6) can render the apparatus almost unnoticeable.

Definitions

Door operating apparatus (2): A mechanism rotationally coupled to a door (4) for providing torque for opening and/or closing such door.

Automatic door operating system (25): Control elements for controlling a door operating apparatus (2).

Enclosure (8): A container in which the door operating apparatus (2) and automatic door operating system (25) are enclosed. The enclosure (8) has two halves, viz., an upper portion (10) and a lower portion (12). When installed, the lower portion (12) is cemented in-place or otherwise anchored in a sub-floor stratum (6). The upper portion (10) is a plate that attaches to the lower portion (12) by means of fasteners (16). The upper and lower portions (10 and 12) of the enclosure may each have a flange. When the upper and lower portions (10 and 12) of the enclosure are attached to one another, a seal may be formed by using a gasket (22) positioned between the two flanges.

Sub-Floor Stratum (6): Any stratum that is sufficiently proximal to a floor surface so as to be subject to moisture and/or dust conditions characteristic of a floor surface.

Spindle (18): A vertical shaft protruding from the sub-floor mounted door operating apparatus (2) that engages a bottom arm (50) located in the bottom of the door panel (4). Conventionally, the spindle (18) defines a "male" component mounted in the apparatus and the bottom arm (50) includes a "female" component for achieving the engagement with the spindle (18). The spindle (18) is coupled to an adjustable chain sprocket, a drive belt pulley, or a geared direct drive, which, in turn, is coupled to an automatic door operator drive system for the provision of torque. The spindle (18) is mounted in a tapered bearing on a base plate and is laterally secured within a bushing on a top plate.

Door Arm (50): A structure or member attached to a door (4) and capable of being coupled to a spindle (18) for transmitting torque from the spindle to the door.

Spindle Housing (52): An assembly comprising a top plate with bushing, a base plate with a tapered bearing, and vertical support plates.

Mounting Sled (48): A structural support to which the spindle housing (52), door operating apparatus (2), and automatic operator system (25) are attached.

First Sealing Ring (20): A cylindrical seal that is placed around the spindle (18) of the door operating apparatus (2) and is inserted into the first hole (14) in the enclosure (8) and bonded to the enclosure by means of a sealant (40) for creating a seal therebetween against moisture and/or dust encroachment with respect to the interior of the enclosure (8). The First Sealing Ring creates a water-tight environment for the electronic components and makes the enclosure (8) watertight. The First Sealing Ring accommodates the rotation of the spindle (18) and is reusable after accessing the interior of the enclosure (8). In the present application, there is a related Second Sealing Ring (30) having a similar function as the First Sealing Ring (20), except that the Second Sealing Ring is associated with the threshold cover (26), the flooring material cover (34), or the flat transition plate (38).

Perimeter Gasket (22): A gasket, preferably vinyl, placed around the perimeter of the enclosure (8) sandwiched between the flanges of upper and lower portions (10 and 12) of the enclosure.

Splice Sealant (46): A sealant (46) placed between any splices in the upper portion (42) of the enclosure or in either the plate (44) version of the threshold or the flooring version of the threshold. A preferred sealant is silicone.

Flooring Material (34): A material other than a threshold plate that is sometimes used in the area of the threshold to transition the interior and exterior flooring, while covering the enclosure (8) and (10). The flooring material is typically stone, tile, wood, or concrete, but can be made of other materials. The flooring material (34) over the enclosure (8) and (10) must be removable for service entry of the door operating apparatus (2).

What is claimed is:

1. A method for retrofit mounting, within a sub-floor stratum, a powering apparatus for a swinging door, at least a portion of the apparatus being intolerant to moisture, the apparatus comprising a mechanism for providing torque, a control mechanism, and a spindle coupled to the torque mechanism, the method comprising:

mounting a lower portion of an enclosure within the sub-floor stratum;

installing the powering apparatus within the enclosure lower portion with the spindle projecting upward;

mounting an upper portion of the enclosure to the lower portion with a gasket therebetween with a securing means, the enclosure thereby being moisture tight when the upper portion and the lower portion are mutually attached;

engaging the spindle with the door, the spindle projecting upward through an opening in the upper portion of the enclosure;

sealing the opening in the upper portion of the enclosure through which the spindle passes to permit free rotation of the spindle within the opening as powered by the torque mechanism, the opening being thereby moisture tight; and removing the upper portion from the lower portion while the door is attached to the spindle.

2. The method according to claim 1, wherein the upper portion of the enclosure comprises at least two elements, at least one of the at least two elements being attachable and detachable from the lower portion to provide access to the powering apparatus without disengaging the door from the spindle.

3. The method according to claim 2, wherein the step of installing the powering apparatus within the enclosure lower portion can be accomplished when the at least one of the at least two elements is detached from the lower portion of the enclosure.

4. The method according to claim 1, wherein the powering apparatus comprises all operating components necessary for applying the torque to the door and controlling the application of the torque.

5. The method according to claim 2, wherein the powering apparatus comprises all operating components necessary for applying the torque to the door and controlling the application of the torque.

* * * * *

UNITED STATES PATENT AND TRADEMARK OFFICE

CERTIFICATE OF CORRECTION

PATENT NO. : 8,434,268 B2
APPLICATION NO. : 13/216071
DATED : May 7, 2013
INVENTOR(S) : Nixon It is certified that error appears in the above-identified patent and that said Letters Patent is hereby corrected as shown below:

Specification

Column 1, line 46, delete “Büach-Zürich” and insert --Bülach-Zürich--.

Signed and Sealed this
Twenty-fourth Day of February, 2015

Michelle K. Lee

Michelle K. Lee
*Deputy Director of the United States Patent and Trademark Office*